US010670012B2

(12) United States Patent
Taguchi

(10) Patent No.: US 10,670,012 B2
(45) Date of Patent: Jun. 2, 2020

(54) VARIABLE DISPLACEMENT COMPRESSOR FOR VEHICLE AIR CONDITIONING SYSTEM

(71) Applicant: SANDEN HOLDINGS CORPORATION, Isesaki-shi (JP)

(72) Inventor: Yukihiko Taguchi, Isesaki (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 420 days.

(21) Appl. No.: 15/532,685

(22) PCT Filed: Dec. 1, 2015

(86) PCT No.: PCT/JP2015/083692
§ 371 (c)(1),
(2) Date: Jun. 2, 2017

(87) PCT Pub. No.: WO2016/088735
PCT Pub. Date: Jun. 9, 2016

(65) Prior Publication Data

US 2017/0356439 A1 Dec. 14, 2017

(30) Foreign Application Priority Data

Dec. 2, 2014 (JP) ..... 2014-244251

(51) Int. Cl.
*F04B 53/10* (2006.01)
*F04B 27/18* (2006.01)
(Continued)

(52) U.S. Cl.
CPC ..... *F04B 53/10* (2013.01); *F04B 27/1804* (2013.01); *F04B 27/0878* (2013.01);
(Continued)

(58) Field of Classification Search
CPC .. F04B 27/00; F04B 27/0873; F04B 27/0878; F04B 2027/1809; F04B 2027/1813;
(Continued)

(56) References Cited

U.S. PATENT DOCUMENTS

2004/0258536 A1* 12/2004 Ota ..... F04B 27/1804 417/222.2
2010/0104454 A1* 4/2010 Ota ..... F04B 27/1804 417/222.1
2011/0214564 A1* 9/2011 Okuda ..... F04B 27/1081 91/505

FOREIGN PATENT DOCUMENTS

JP 2005-9422 1/2005
JP 2011-185138 9/2011

OTHER PUBLICATIONS

US-2011/0214564 corresponds to JP 2011-185138 and is discussed on p. 1 of the specification.
US-2004/0258536 corresponds to JP 2005-009422.

* cited by examiner

*Primary Examiner* — Patrick Hamo
*Assistant Examiner* — Chirag Jariwala
(74) *Attorney, Agent, or Firm* — Cozen O'Connor

(57) ABSTRACT

Variable displacement compressor 100 has second control valve 350 for adjusting the opening degree of pressure release passage 146. Second control valve 350 includes partition member 351, which partitions valve chamber 351*c* and back pressure chamber 351*d*, and has side wall 351*a* surrounding valve portion 352*b* of spool 352, and end wall 351*b* connected to one end side of side wall 351*a* and through which shaft portion 352*b* of spool 352 penetrates. Furthermore, in second control valve 350, end surface 351*a*1 opposite to the end wall of the side wall of partition member 351 abuts on the wall surface opposite to the back pressure
(Continued)

chamber of the valve chamber 351*c*. When the valve portion 352*b* of spool 352 abuts on the wall surface, pressure receiving portion 352*a* of spool 352 abuts on end wall 351*b*.

7 Claims, 7 Drawing Sheets

(51) Int. Cl.
*F04B 27/08* (2006.01)
*F04B 27/10* (2006.01)
*F04B 53/16* (2006.01)

(52) U.S. Cl.
CPC ..... *F04B 27/1045* (2013.01); *F04B 53/16* (2013.01); *F04B 2027/1813* (2013.01); *F04B 2027/1827* (2013.01); *F04B 2027/1831* (2013.01); *F04B 2027/1845* (2013.01)

(58) Field of Classification Search
CPC ..... F04B 2027/1822; F04B 2027/1827; F04B 2027/1831; F04B 2027/184; F04B 2027/1845; F04B 2027/185; F04B 27/1045; F04B 53/10; F04B 53/16
See application file for complete search history.

VARIABLE DISPLACEMENT COMPRESSOR FOR VEHICLE AIR CONDITIONING SYSTEM

RELATED APPLICATIONS

This is a U.S. National Phase Application under 35 USC 371 of International Application PCT/JP2015/083692 filed on Dec. 1, 2015.

This application claims the priority of Japanese application no. 2014-244251 filed Dec. 2, 2014, the entire content of which is hereby incorporated by reference.

TECHNICAL FIELD

The present invention relates to a variable displacement compressor and particularly relates to a variable displacement compressor for use in a vehicle air-conditioner system.

BACKGROUND ART

Patent Document 1 discloses a variable displacement compressor having a first control valve 33 varying the passage cross-sectional area of a pressure supply passage for supplying a refrigerant to a crank chamber from a discharge pressure region and a second control valve 34 varying the passage cross-sectional area of a pressure release passage for discharging the refrigerant from the crank chamber to a suction pressure region.

REFERENCE DOCUMENT LIST

Patent Document

Patent Document 1: Japanese Patent Application Laid-open Publication No. 2011-185138

SUMMARY OF THE INVENTION

Problems to be Solved by the Invention

In the second control valve 34 of the variable displacement compressor of Patent Document 1, a first notched groove 542 serves as a throttle passage in a state where an end surface 573 on the side of a discharge chamber 59 of a second valve portion 57 is in contact with the tip surface of a projection 541 and, in this case, the tip surface of a projection 563 of a first valve portion 56 needs to abut on a bottom surface 591 of the discharge chamber 59. More specifically, in the second control valve of Patent Document 1, an operation is indispensable which adjusts the fitting position to the first valve portion 56 of the second valve portion in a state where the first valve portion 56, a valve seat forming ring 54, and the second valve portion 57 are actually accommodated in a cylinder block 11. Therefore, there has been a problem in that the abutment between the end surface 573 and the tip surface of the projection 541 and the abutment between the tip surface of the projection 563 and a bottom surface 591 of the discharge chamber 59 have not been able to be examined, and thus it has not been able to be judged whether the abutment states are appropriate.

The configurations, such as the first valve portion 56, the valve seat forming ring 54, and the second valve portion 57 in the second control valve 34, are based on the premise that they are accommodated in the cylinder block 11, and thus they are not configured so as to be able to be accommodated in a cylinder head from an open end (valve plate 14 side) of a cylinder head (rear housing 13), for example. More specifically, it has not been taken into consideration that they are disposed in the cylinder head, which has posed a problem in that the layout is restricted.

Then, it is an object of the present invention to provide a variable displacement compressor which enables a second control valve to be examined before the second control valve is incorporated in the compressor and which enables the second control valve to be disposed with ease.

Means for Solving the Problems

In a variable displacement compressor according to one aspect of the present invention, a refrigerant in a discharge pressure region is supplied to a crank chamber through a pressure supply passage and the refrigerant in the crank chamber is discharged into a suction pressure region through a pressure release passage, so that a pressure in the crank chamber is regulated, whereby the discharge volume is controlled by the pressure regulation in the crank chamber, and the variable displacement compressor has a first control valve that adjusts the opening degree of the pressure supply passage and a second control valve that adjusts the opening degree of the pressure release passage. The second control valve has a back pressure chamber that communicates with a region on the downstream side relative to the first control valve in the pressure supply passage, a valve chamber which is partitioned from the back pressure chamber by a partition member to form a part of the pressure release passage and is provided with a valve hole communicating with the crank chamber in the wall surface on the side opposite to the back pressure chamber, and a spool having a pressure receiving portion disposed in the back pressure chamber, a valve portion disposed in the valve chamber, and a shaft portion which extends penetrating through the partition member to connect the pressure receiving portion and the valve portion. When the first control valve is opened and a force of moving the spool in a direction of approaching the valve hole by a pressure applied to the pressure receiving portion becomes larger than a force of moving the spool in a direction of separating from the valve hole by a pressure applied to the valve portion, then the valve portion abuts on the wall surface of the valve chamber, to thereby close the valve hole, so that the opening degree of the pressure release passage is set to the minimum degree, and when the first control valve is closed and the force of moving the spool in the direction of approaching the valve hole by the pressure applied to the pressure receiving portion becomes smaller than the force of moving the spool in the direction of separating from the valve hole by the pressure applied to the valve portion, then the valve portion is separated from the wall surface, to thereby open the valve hole, so that the opening degree of the pressure release passage is set to the maximum degree. The partition member has a side wall provided so as to surround the valve portion and an end wall which is connected to one end side of the side wall and has a through-hole through which the shaft portion penetrates, and is positioned so that an end surface on a side opposite to the end wall of the side wall abuts on the wall surface of the valve chamber. When the valve portion of the spool abuts on the wall surface of the valve chamber, the pressure receiving portion of the spool abuts on the end wall of the partition member.

Effects of the Invention

According to the variable displacement compressor, the second control valve can be examined before the second control valve is incorporated in the compressor and the second control valve can be easily disposed.

MODE FOR CARRYING OUT THE INVENTION

Hereinafter, Examples of the present invention will be described with reference to the accompanying drawings.

Figure 1:
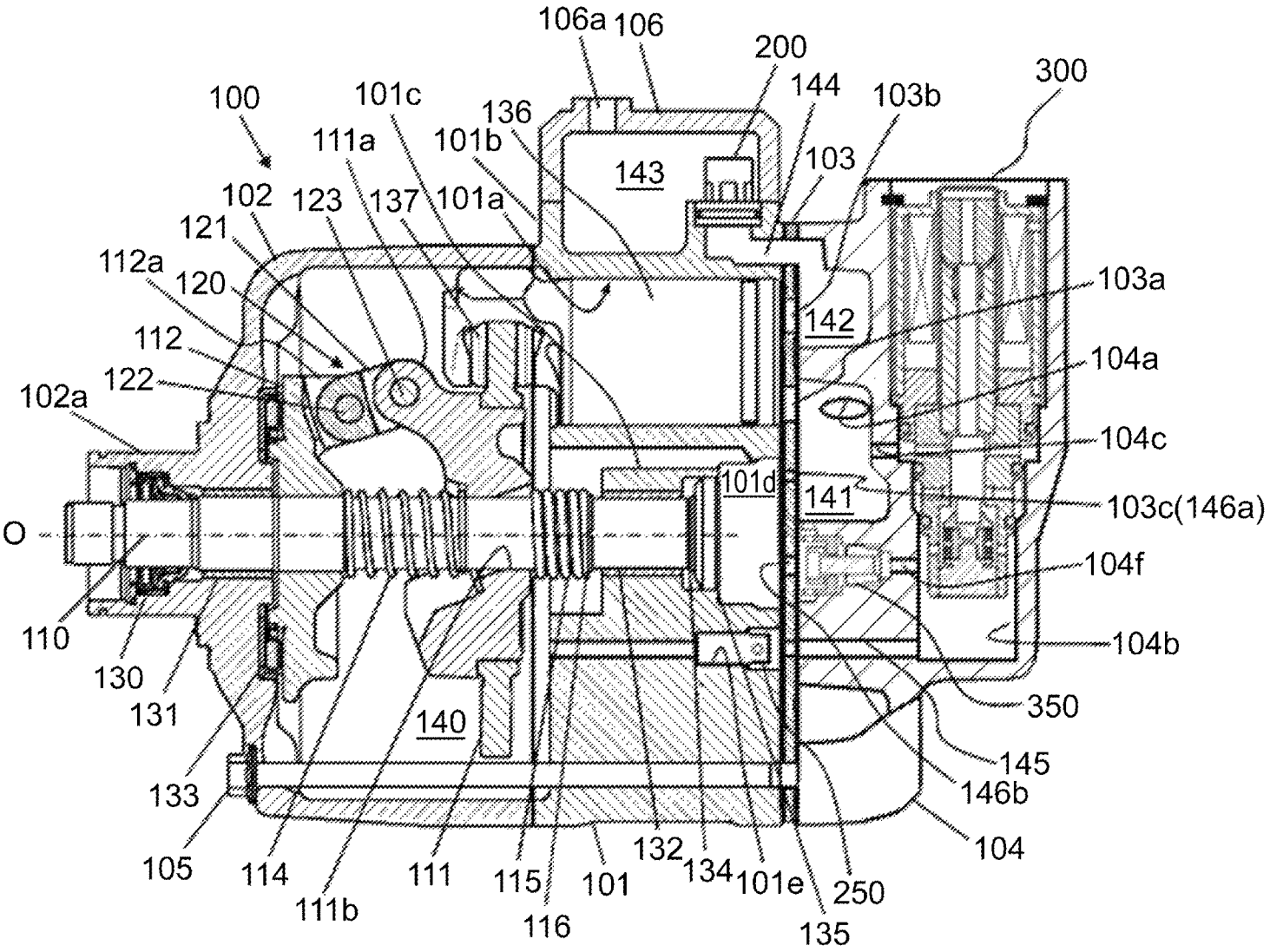
FIG. 1 is a view illustrating a variable displacement compressor to which the present invention is applied.

A variable displacement compressor 100 illustrated in FIG. 1 is a clutchless compressor and has a cylinder block 101 having a plurality of cylinder bores 101*a*, a housing 102 provided at one end of the cylinder block 101, and a cylinder head 104 provided at the other end of the cylinder block 101 through a valve plate 103.

A drive shaft 110 passes through a crank chamber 140 defined by the cylinder block 101 and the front housing 102. A swash plate 111 is placed around an axial center part of the drive shaft 110. The swash plate 111 is connected, via a link mechanism 120, to a rotor 112 fixed to the drive shaft 110, and the inclination angle of the swash plate 111 with respect to the drive shaft 110 is variable.

The linkage mechanism 120 includes a first arm 112*a* protruding from the rotor 112, a second arm 111*a* protruding from the swash plate 111, and a link arm 121, one end of which is rotatably connected to the first arm 112*a* via a first connecting pin 122 and the other end of which is rotatably connected to the second arm 111*a* via a second connecting pin 123.

The swash plate 111 has a through hole 111*b* shaped so that the swash plate 111 can be inclined in a range from a maximum inclination angle to a minimum inclination angle. A minimum inclination angle regulation part that contacts the drive shaft 110 is formed in the through hole 111*b*. The minimum inclination angle regulation part in the through hole 111*b* allows the swash plate 111 to be inclined to approximately 0°, where 0° is the inclination angle of the swash plate 111 when the swash plate 111 is orthogonal to the drive shaft 110. The maximum inclination angle of the swash plate is regulated by abutment of the swash plate 111 on the rotor 112.

To the drive shaft 110, an inclination angle decreasing spring 114 for biasing the swash plate 111 in a direction of decreasing the inclination angle and an inclination angle increasing spring 115 for biasing the swash plate 111 in a direction of increasing the inclination angle are attached with the swash plate 111 interposed therebetween. Specifically, the inclination angle decreasing spring 114 is disposed between the swash plate 111 and the rotor 112 and the inclination angle increasing spring 115 is disposed between the swash plate 111 and a spring support member 116 fixed or formed to/in the drive shaft 110.

When the inclination angle of the swash plate 111 is the minimum inclination angle, the biasing force of the inclination angle increasing spring 115 is set to be larger than the biasing force of the inclination angle decreasing spring 114. Accordingly, when the drive shaft 110 is not rotating, the swash plate 111 is positioned at a predetermined inclination angle (>minimum inclination angle) at which the resultant force of the biasing force of the inclination angle decreasing spring 114 and the biasing force of the inclination angle increasing spring 115 is zero. The predetermined inclination angle is set in the minimum inclination angle range in which a compression operation by a piston 136 is secured and can be set in the range of 1 to 3°, for example.

One end of the drive shaft 110 passes through a boss portion 102*a* protruding out of the housing 102 and extends to the outside, and is connected to a power transmission device which is not illustrated. A shaft sealing device 130 is provided between the drive shaft 110 and the boss portion 102*a*, to block the inside of the crank chamber 140 from the outside. A connection body of the drive shaft 110 and the rotor 112 is supported by bearings 131 and 132 in the radial direction and is supported by a bearing 133 and a thrust plate 134 in the thrust direction. In other words, the drive shaft 110 is rotatably supported by the compressor body. The gap between an end portion on the side of the thrust plate 134 of the drive shaft 110 and the thrust plate 134 is adjusted to a predetermined gap by an adjusting screw 135. When power from an external drive source is transmitted to the power transmission device (not illustrated), the drive shaft 110 rotates synchronously with the rotation of the power transmission device.

A piston 136 is placed in each cylinder bore 101*a*. An outer peripheral part of the swash plate 111 is housed in an internal space of an end of the piston 136 protruding toward the crank chamber 140, and the swash plate 111 is interlocked with the piston 136 via a pair of shoes 137. This allows the piston 136 to reciprocate in the cylinder bore 101*a* according to the rotation of the swash plate 111. In other words, the swash plate 111 converts the rotation of the drive shaft 110 to the reciprocation motion of the piston 136.

In the cylinder head 104, a suction chamber 141 as a suction pressure region disposed in a center part and a discharge chamber 142 as a discharge pressure region which annularly surrounds the suction chamber 141 on the outside in the radial direction are formed. The suction chamber 141 communicates with the cylinder bore 101*a* via a communication hole 103*a* formed in the valve plate 103 and a suction valve (not illustrated) formed in a suction valve forming plate 150. The discharge chamber 142 communicates with the cylinder bore 101*a* via a discharge valve (not illustrated) formed in a discharge valve forming plate 151 and a communication hole 103*b* formed in the valve plate 103.

The housing 102, a center gasket (not illustrated), the cylinder block 101, a cylinder gasket 152, the suction valve forming plate 150, the valve plate 103, the discharge valve forming plate 151, a head gasket 153, and the cylinder head 104 are sequentially connected, and then fastened together with a plurality of through bolts 105, to form a compressor body.

In an upper portion of the cylinder block 101, a muffler is provided. The muffler is formed by fastening a lid member 106 in which a discharge port 106*a* is formed and a formation wall 101*b* which is partitioned in an upper portion of the cylinder block 101, with a bolt through a seal member which is not illustrated. A muffler space 143 in the muffler is connected to the discharge chamber 142 through the communication passage 144. In the muffler space 143, a discharge check valve 200 is disposed at a connection portion of the communication passage 144 and the muffler space 143. By such a configuration, the discharge chamber 142 is connected to a discharge-side refrigerant circuit of an air-conditioner system through a discharge passage containing the communication passage 144, the discharge check valve 200, the muffler space 143, and the discharge port 106*a*. The discharge check valve 200 operates according to a pressure difference between the communication passage 144 (upstream side) and the muffler space 143 (downstream side). When the pressure difference is smaller than a predetermined value, the communication passage 144 is closed. When the pressure difference is larger than a predetermined value, the communication passage 144 is opened.

In the cylinder head 104, a suction passage containing a suction port (not illustrated) and a communication passage 104*a* is formed. The suction passage linearly extends so as to cross a part of the discharge chamber 142 from outside in the radial direction of the cylinder head 104. The suction chamber 141 is connected to a suction-side refrigerant circuit of the air-conditioner system through the suction passage.

The cylinder head 104 is further provided with a first control valve 300. The first control valve 300 is accommodated in an accommodation hole 104*b* formed so as to extend in the radial direction in the cylinder head 104. The first control valve 300 adjusts the opening degree of a pressure supply passage 145 allowing the discharge chamber 142 and the crank chamber 140 to communicate with each other according to the pressure of the suction chamber 141 introduced through a communication passage 104*c* and the electromagnetic force generated by a current flowing into a solenoid based on an external signal. Thus, the first control valve 300 controls the amount of the refrigerant in the discharge pressure region to be supplied to the crank chamber 140 through the pressure supply passage 145.

In the pressure supply passage 145 on the downstream relative to the first control valve 300, a check valve 250 described later is arranged. The check valve 250 is interlocked with opening and closing of the first control valve 300 to open and close the pressure supply passage 145. The check valve 250 and the pressure supply passage 145 are described in detail later.

The refrigerant in the crank chamber 140 flows into the suction chamber 141 through a pressure release passage 146 containing a first pressure release passage 146*a* via a communication passage 101*c*, a space 101*d*, and a fixed throttle 103*c* formed in the valve plate 103, and a second pressure release passage 146*b* via a second control valve 350 described later. More specifically, the refrigerant in the crank chamber 140 is discharged into the suction pressure region through the pressure release passage 146. The flow passage cross-sectional area in the second control valve 350 is set to be larger than the flow passage cross-sectional area of the fixed throttle 103*c*.

When the first control valve 300 and the check valve 250 are closed, a second control valve 350 opens the second pressure release passage 146*b*, so that the pressure release passage 146 contains the first pressure release passage 146*a* and the second pressure release passage 146*b*. Thus, the refrigerant in the crank chamber 140 promptly flows into the suction chamber 141. Then, the pressure of the crank chamber 140 becomes equivalent to the pressure of the suction chamber 141, so that the inclination angle of the swash plate reaches the maximum inclination angle, and thus the piston stroke (discharge volume) reaches the maximum thereof.

When the first control valve 300 and the check valve 250 are open, the second control valve 350 closes the second pressure release passage 146*b*, so that the pressure release passage 146 contains only the first pressure release passage 146*a*. Therefore, the flow of the refrigerant in the crank chamber 140 into the suction chamber 141 is restricted, so that the pressure of the crank chamber 140 easily increases. Then, due to the increase in the pressure of the crank chamber 140, the inclination angle of the swash plate 111 decreases from the maximum angle. Thus, the piston stroke can be variably controlled.

As described above, in the variable displacement compressor 100, the refrigerant in the discharge pressure region is supplied to the crank chamber 140 through the pressure supply passage 145 and the refrigerant in the crank chamber 140 is discharged into the suction pressure region through the pressure release passage 146, so that the pressure in the crank chamber 140 is regulated, whereby the discharge volume is controlled by the pressure regulation in the crank chamber 140. And, the variable displacement compressor 100 has the first control valve 300 adjusting the opening degree of the pressure supply passage 145 and the second control valve 350 adjusting the opening degree of the pressure release passage 146.

Hereinafter, the first control valve 300 will be described with reference to FIG. 2 and FIG. 3.

Figure 2:
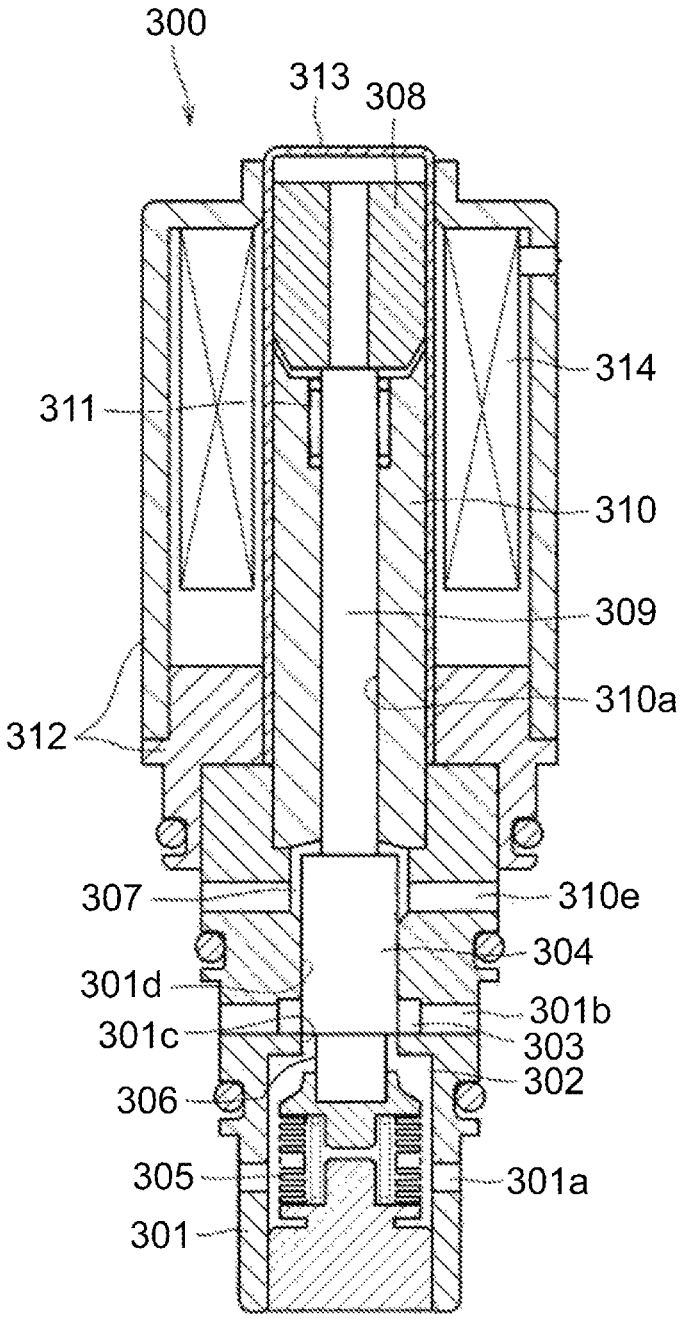
FIG. 2 is a view illustrating a first control valve provided in the variable displacement compressor.
Figure 3:
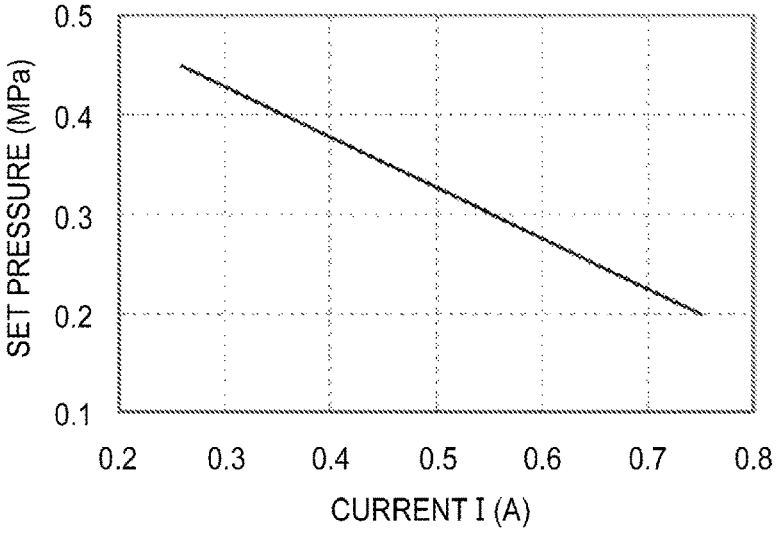
FIG. 3 is a view illustrating the control characteristics of the first control valve.

As illustrated in FIG. 2, the first control valve 300 includes a valve unit and a drive unit (solenoid) actuating the valve unit to open and close.

The valve unit has a cylindrical valve housing 301. In the valve housing, a first pressure sensing chamber 302, a valve chamber 303, and a second pressure sensing chamber 307 are formed in this order in the axial direction. The first pressure sensing chamber 302 communicates with the crank chamber 140 through a communication hole 301*a* formed in the outer peripheral portion of the valve housing 301. The second pressure sensing chamber 307 communicates with the suction chamber 141 through a communication hole 301*e* formed in the outer peripheral portion of the valve housing 301 and the communication passage 104*c*. The valve chamber 303 communicates with the discharge chamber 142 through a communication hole 301*b* formed in the outer peripheral portion of the valve housing 301. The first pressure sensing chamber 302 and the valve chamber 303 are allowed to communicate with each other through a valve hole 301*c*. A support hole 301*d* is formed between the valve chamber 303 and the second pressure sensing chamber 307.

A bellows 305 is arranged in the first pressure sensing chamber 302. The bellows 305 has a spring in the vacuum inside. The bellows 305 is arranged so as to be deformable in the axial direction of the valve housing 301 and has a function as a pressure sensing unit receiving the pressure in the first pressure sensing chamber 302, i.e., the pressure in the crank chamber 140.

A valve body 304 of a columnar shape is accommodated in the valve chamber 303. The outer peripheral surface of the valve body 304 is in close contact with the inner peripheral surface of the support hole 301*d* and the valve body 304 is slidable in the support hole 301*d* and is movable in the axial direction of the valve housing 301. One end of the valve body 304 can open and close the valve hole 301*c* and the other end is protruding into the second pressure sensing chamber 307.

To one end of the valve body 304, one end of a connection portion 306 of a rod shape is fixed. The connection portion 306 is disposed so that the other end can abut on the bellows 305 and has a function of transmitting the deformation of the bellows 305 to the valve body 304.

The drive unit has a cylindrical solenoid housing 312. The solenoid housing 312 is connected to the other end of the valve housing 301 so as to be coaxial with the valve housing 301. A molded coil 314, in which an electromagnetic coil is covered with resin, is accommodated in the solenoid housing 312 and a cylindrical fixed core 310 is concentrically accommodated thereinside. The fixed core 310 extends from the valve housing 301 to a position corresponding to the center of the molded coil 314. An end portion of the fixed core 310 on the side opposite to the valve housing 301 is surrounded by a cylindrical sleeve 313 to be closed.

The fixed core 310 has an insertion hole 310*a* in the center. One side of the insertion hole 310*a* opens to the second pressure sensing chamber 307. Between the fixed core 310 and the closed end of the sleeve 313, a cylindrical movable core 308 is accommodated.

A solenoid rod 309 is inserted into the insertion hole 310*a*. One end of the solenoid rod 309 is press-fitted into and fixed to the valve body 304 so as to be coaxial with the valve body 304. The other end portion of the solenoid rod 309 is press-fitted into a through-hole formed in the movable core 308, so that the solenoid rod 309 and the movable core 308 are integrated. Between the fixed core 310 and the movable core 308, a forcibly releasing spring 311 is provided which biases the movable core 308 in a direction (valve opening direction) of separating from the fixed core 310.

The movable core 308, the fixed core 310, and the solenoid housing 312 are formed of a magnetic material and form the magnetic circuit. The sleeve 313 is formed of a nonmagnetic stainless steel-based material.

A control device (not illustrated) provided outside the compressor 100 is connected to the molded coil 314. When a control current I is applied to the molded coil 314 from the control device, the molded coil 314 generates an electromagnetic force F(I). The electromagnetic force F(I) of the molded coil 314 attracts the movable core 308 toward the fixed core 310. More specifically, the force generated by the electromagnetic force F(I) of the molded coil 314 acts on the valve body 304 in a valve closing direction.

The force acting on the valve body 304 in the first control valve 300 includes, besides the electromagnetic force F(I) generated by the molded coil 314, a biasing force fs of the forcibly releasing spring 311, a force generated by the pressure (discharge pressure Pd) of the valve chamber 303, a force generated by the pressure (crank pressure Pc) of the first pressure sensing chamber 302, a force generated by the pressure (suction pressure Ps) of the second pressure sensing chamber 307, and a bellows biasing force Fb of the spring built in the bellows 305. The relationship therebetween is represented by Expression (1) shown below because the effective pressure receiving area Sb of the bellows 305, the seal area Sv, which is the area of the valve hole 301*c* closed by the valve body 304, and the cross-sectional area Sr of the cylindrical outer peripheral surface of the valve body 304 are Sb=Sv=Sr. In Expression (1), + represents the valve closing direction of the valve body 304 and − represents the valve opening direction.

$$Ps = -\frac{1}{Sb} \cdot F(f) + \frac{Fb + fs}{Sb} \quad (1)$$

When the pressure of the suction chamber 141 increases to be higher than the set pressure, a connection body of the bellows 305, the connection portion 306, and the valve body 304 reduces the opening degree of the pressure supply passage 145 so as to increase the discharge volume to reduce the pressure of the crank chamber 140. When the pressure of the suction chamber 141 decrease to be less than the set pressure, the connection body increases the opening degree of the pressure supply passage 145 so as to reduce the discharge volume to increase the pressure of the crank chamber 140. Thus, the connection body autonomously controls the opening degree of the pressure supply passage 145 so that the pressure of the suction chamber 141 is close to the set pressure.

An electromagnetic force acts on the valve body 304 in the valve closing direction through the solenoid rod 309. Therefore, when the current application amount to the molded coil 314 increases, the force in a direction of reducing the opening degree of the pressure supply passage 145 increases, so that the set pressure varies in a reducing direction as illustrated in FIG. 3.

The drive unit is driven by pulse width modulation (PWM control) at a predetermined frequency in the range of 400 Hz to 500 Hz, for example, so that the pulse width (duty ratio) is varied in such a manner that the value of a current flowing through the molded coil 314 is a desired value.

When the air-conditioner is operated, i.e., in an operation state of the variable displacement compressor 100, the current application amount to the molded coil 314 is adjusted based on the air-conditioning setting and/or the outside environment, whereby the discharge volume is controlled so that the pressure of the suction chamber 141 is set to the set pressure corresponding to the current application amount. When the air-conditioner is not operated, i.e., in a non-operation state of the variable displacement compressor 100, the current application to the molded coil 314 is turned OFF, whereby the pressure supply passage 145 is opened by the forcibly releasing spring 311, so that the discharge volume of the variable displacement compressor 100 is controlled to be the minimum volume.

Figure 4A:
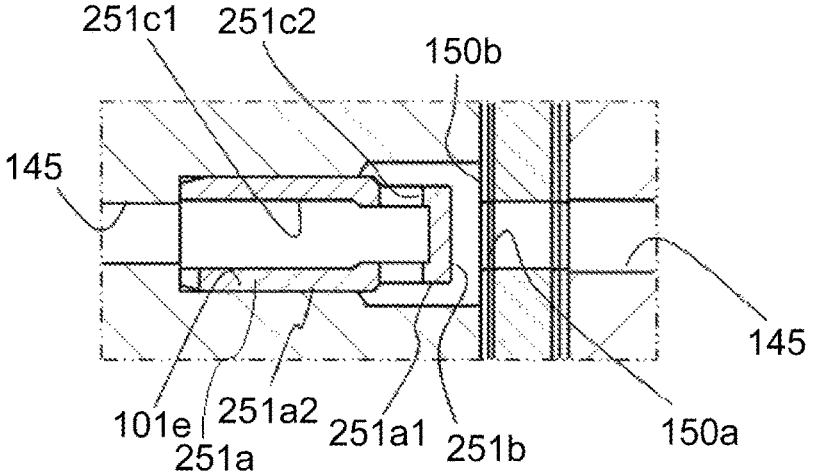
FIGS. 4A and 4B are views illustrating a check valve provided in the variable displacement compressor.
Figure 4B:
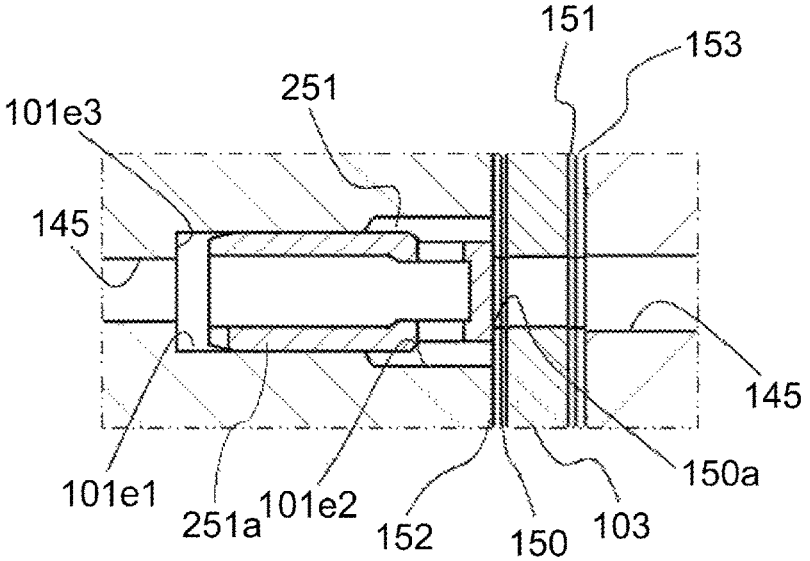

Hereinafter, the check valve 250 will be described with reference to FIGS. 4A and 4B.

The check valve 250 is arranged in the pressure supply passage 145 on the downstream relative to the first control valve 300. The check valve 250 has a valve body 251, an accommodation hole 101*e* accommodating the valve body 251, and a suction valve forming plate 150 as a valve seat formation member closing one end of the accommodation hole 101*e* having a valve hole 150*a* and a valve seat 150*b*. In the suction valve forming plate 150, the valve hole 150*a* and the valve seat 150*b* are formed.

The valve body 251 has a cylindrical side wall 251*a* and an end wall 251*b* closing one end of the side wall 251*a*. The cylindrical side wall 251*a* includes a small diameter portion 251*a*1 and a large diameter portion 251*a*2 having a diameter larger than the diameter of the small diameter portion 251*a*1. In the valve body 251, an internal passage containing a first passage 251*c*1 formed from the open end of the side wall 251*a* toward the end wall 251*b* and a second passage 251*c*2 connecting the outer peripheral surface of the small diameter portion 251*a*1 and the first passage 251*c*1, is formed. The valve body 251 is formed of a resin material, for example, but may be formed of other materials, such as a metal material.

In the end surface on the side of the valve plate 103 of the cylinder block 101, an accommodation hole 101*e* containing a small diameter portion 101*e*1 and a large diameter portion 101*e*2 having a diameter larger than the diameter of the small diameter portion 101*e*1 is formed. The large diameter portion 251*a*2 of the valve body is slidably supported by the small diameter portion 101*e*1 of the accommodation hole. A space between the small diameter portion 251*a*1 of the valve body and a large diameter portion 101*e*2 of the accommodation hole forms an annular passage. The annular passage communicates with the internal passage containing the second passage 251*c*2 and the first passage 251*c*1.

The accommodation hole 101*e* is formed so as to be orthogonal to the end surface of the cylinder block 101. The valve body 251 moves in the axial direction of the drive shaft 110. When the end wall 251*b* of the valve body abuts on the valve seat 150*b* of the suction valve forming plate, the movement of the valve body 251 in one direction is regulated. When the other end of the side wall 251*a* abuts on the end surface 101*e*3 of the accommodation hole, the movement of the valve body 251 in other direction is regulated. When the end wall 251*b* abuts on the valve seat 150*b*, the valve hole 150*a* is closed. When the end wall 251*b* is separated from the valve seat 150*b*, the valve hole 150*a* is opened.

The accommodation hole 101*e* communicates with the pressure region of the crank chamber 140 on the downstream relative to the valve hole 301*c* of the first control valve 300 in the accommodation hole 104*b* through the pressure supply passage 145 on the upstream relative to the check valve 250. In the end surface 101*e*3 of the accommodation hole 101*e*, the pressure supply passage 145 on the downstream relative to the check valve 250 is formed and the pressure supply passage 145 communicates with the crank chamber 140.

Therefore, a pressure Pm of the pressure supply passage 145 on the upstream relative to the check valve 250 acts on one end of the valve body 251 and a pressure Pc of the crank chamber 140 on the downstream relative to the check valve 250 acts on the other end of the valve body 251, so that the valve body 251 moves in the axial direction according to the pressure difference (Pm−Pc) between the upstream pressure and the downstream pressure acting on the valve body 251.

The pressure supply passage 145 between the first control valve 300 and the check valve 250 communicates with the suction chamber 141 via a throttle passage described later. Therefore, in the state where the valve body 304 of the first control valve 300 opens the valve hole 301*c*, a refrigerant gas in the discharge chamber 142 reaches the valve hole 150*a* of the check valve 250 via the pressure supply passage 145 on the downstream relative to the valve hole 301*c*. Therefore, the upstream pressure acting on one end of the valve body 251, i.e., the pressure Pm of the pressure supply passage 145 on the upstream relative to the check valve 250, increases, so that Pm−Pc>0 is established. Then, by the pressure difference (Pm−Pc) between the upstream pressure and the downstream pressure acting on the valve body 251, the end wall 251*b* of the valve body 251 is separated from the valve seat 150*b*, and then the other end of the side wall 251*a* abuts on the end surface 101*e*3 of the accommodation hole. Thus, the refrigerant gas in the discharge chamber 142 is supplied from the valve hole 150*a* to the crank chamber 140 via the large diameter portion 101*e*2 of the accommodation hole 101*e*, the second passage 251*c*2, the first passage 251*c*1, and the pressure supply passage 145 on the downstream relative to the check valve 250.

When the valve body 304 of the first control valve 300 closes the valve hole 301*c* from the state of opening the valve hole 301*c*, the refrigerant gas in the discharge chamber 142 is not supplied to the pressure supply passage 145 on the downstream relative to the valve hole 301*c*, so that the refrigerant gas in the pressure supply passage 145 between the first control valve 300 and the check valve 250 flows into the suction chamber 141 via the throttle passage described later. Therefore, the upstream pressure acting on one end of the valve body 251 decreases, so that Pm−Pc<0 is established. Then, by the pressure difference (Pm−Pc) between the upstream pressure and the downstream pressure acting on the valve body 251, the other end of the side wall 251*a* is separated from the end surface 101*e*3 of the accommodation hole, so that the end wall 251*b* of the valve body abuts on the valve seat 150*b*, whereby the pressure supply passage 145 on the downstream relative to the check valve 250 and the pressure supply passage 145 on the upstream relative to the check valve are blocked.

Thus, the pressure of the region of the pressure supply passage 145 between the first control valve 300 and the check valve 250 is equivalent to the pressure of the suction chamber 141. That is, the region of the pressure supply passage 145 between the first control valve 300 and the check valve 250 serves as the pressure region of the suction chamber 141.

As described above, the check valve 250 is configured so as to open and close the pressure supply passage 145 interlocking with opening and closing of the first control valve 300.

The check valve 250 may be configured so as to additionally have a biasing unit, such as a compression coil spring, which biases the valve body 251 toward the valve seat 150*b*. The valve seat formation member is not limited to the suction valve forming plate 150 and may be a valve plate, for example.

Figure 5A:
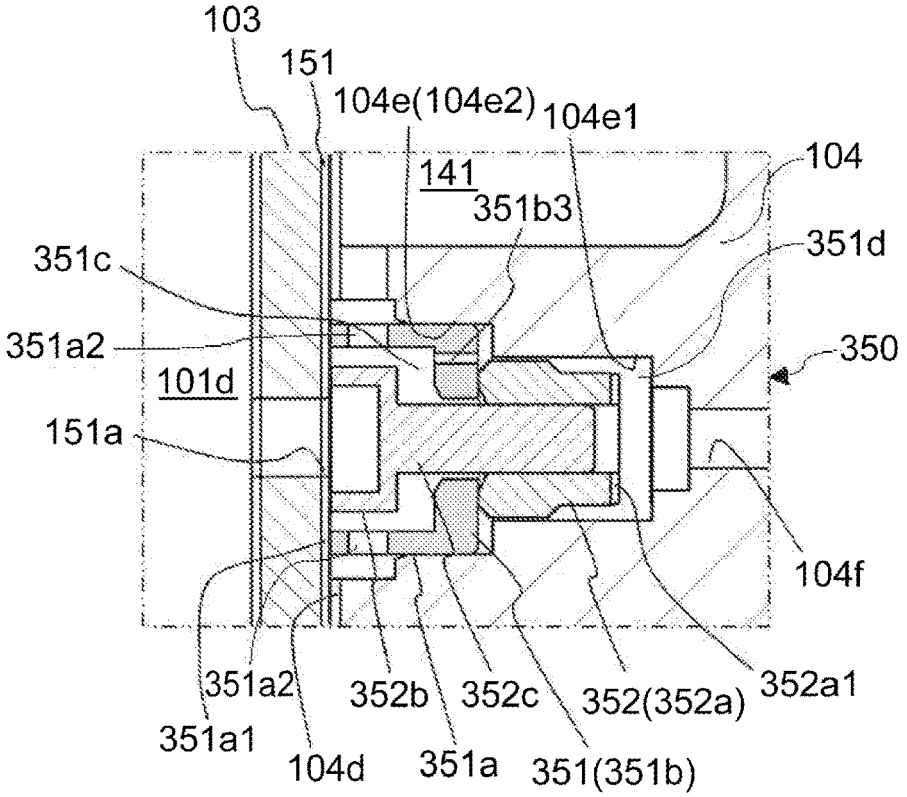
FIGS. 5A and 5B are views illustrating a second control valve provided in the variable displacement compressor.
Figure 5B:
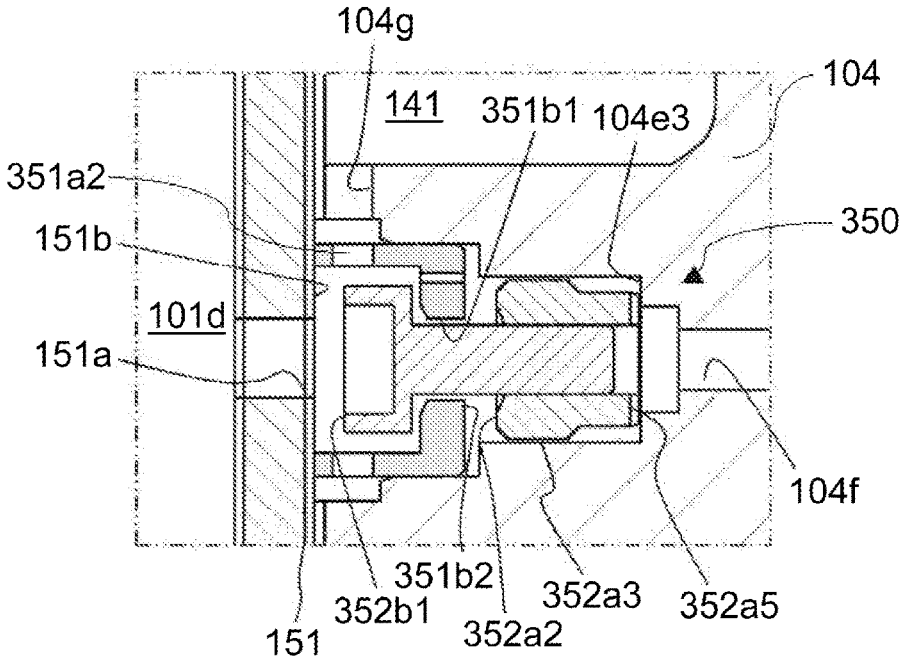
Figure 6:
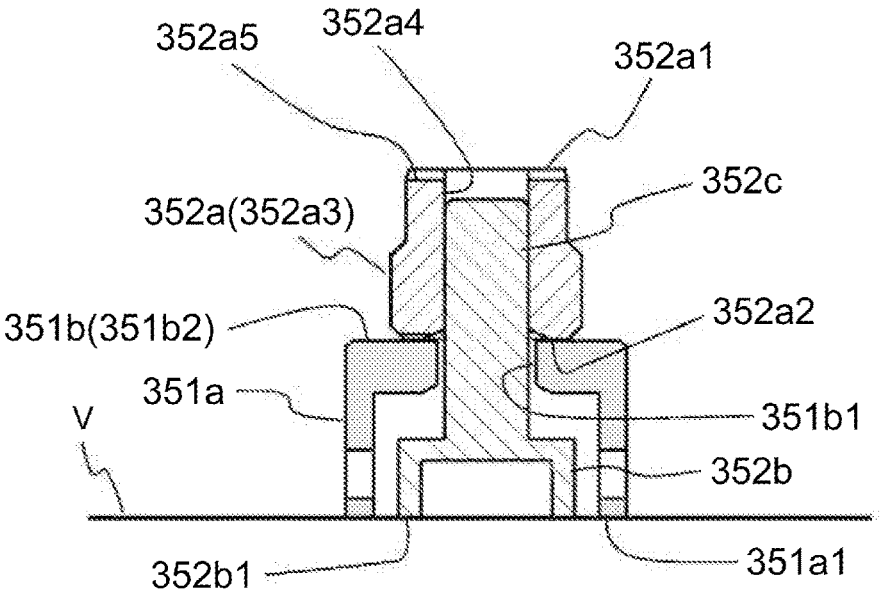
FIG. 6 is a view illustrating an integrated configuration of a spool and a partition member in the second control valve.
Figure 7:
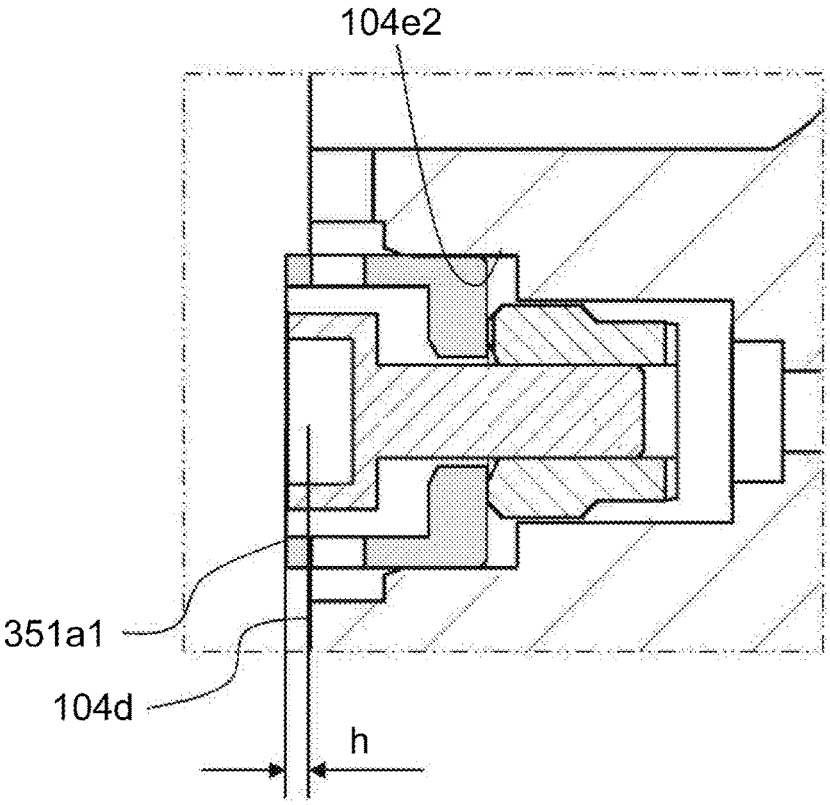
FIG. 7 is a view illustrating a state where the second control valve is temporarily press-fitted into a cylinder head.

Hereinafter, the second control valve 350 will be described with reference to FIGS. 5A and 5B.

The second control valve 350 is arranged on the cylinder head 104, and has a back pressure chamber 351*d* that communicates with a region on the downstream side relative to the first control valve 300 in the pressure supply passage 145, a valve chamber 351*c* which is partitioned from the back pressure chamber 351*d* by a partition member 351 to form a part of the pressure release passage 146 and is provided with a valve hole 151*a* communicating with the crank chamber 140 in a wall surface on a side opposite to the back pressure chamber 351*d*, and a spool 352 having a pressure receiving portion 352*a* disposed in the back pressure chamber 351*d*, a valve portion 352*b* disposed in the valve chamber 351*c*, and a shaft portion 352*c* which extends penetrating through the partition member 351 to connect the pressure receiving portion 352*a* and the valve portion 352*b*.

The accommodation chamber 104*e* in which the second control valve 350 is accommodated is formed on the side of a connection end surface 104*d* with the cylinder block 101 in the cylinder head 104. The accommodation chamber 104*e* is formed into a cylindrical shape and has a large diameter portion on the side of the connection end surface 104*d* of the cylinder head, a small diameter portion having a diameter smaller than the large diameter portion on the deep side, and a level difference portion between the large diameter portion and the small diameter portion. The small diameter portion forms a first accommodation chamber 104*e*1 and the large diameter portion forms a second accommodation chamber 104e2 that accommodates the partition member 351.

The partition member 351 is press-fitted into the peripheral wall of the second accommodation chamber 104e2 to partition the accommodation chamber 104e into the back pressure chamber 351d and the valve chamber 351c, and has a side wall 351a provided so as to surround the valve portion 352b and an end wall 351b which is connected to one end side of the side wall 351a and in which a through-hole 351b1, through which the shaft portion 352c penetrates, is formed. Specifically, the side wall 351a is formed into a cylindrical shape and partitions the second accommodation chamber 104e2 into an inner cylindrical space inside thereof and an outer ring-shaped space outside thereof communicating with the suction chamber 141. The end wall 351b has a through-hole 351b1 formed in a central portion and the end wall 351b, together with the side wall 351a of cylindrical shape, partitions between the first accommodation chamber 104e1 and the inner cylindrical space of the second accommodation chamber 104e2. The inner cylindrical space of the second accommodation chamber 104e2 defined by the side wall 351a and the end wall 351b forms the valve chamber 351c. The outer space of the second accommodation chamber 104e2 defined by the side wall 351a and the end wall 351b, and the first accommodation chamber 104e1 form the back pressure chamber 351d.

The partition member 351 is positioned in the second accommodation chamber 104e2 so that the end surface 351a1 on the side opposite to the end wall 351b of the side wall 351a abuts on the discharge valve forming plate 151 serving as the wall surface on the side opposite to the back pressure chamber 351d in the valve chamber 351c. In the side wall 351a, a communication portion 351a2 is formed which allows the valve chamber 351c and the ring-shaped space in the second accommodation chamber 104e2 outside the side wall 351a to communicate with each other. The valve chamber 351c communicates with the suction chamber 141 through the communication portion 351a2. The communication portion 351a2 may be formed as a hole or may be formed as a notch.

The first accommodation chamber 104e1 communicates with a region which is a pressure region of the crank chamber 140 in the accommodation hole 104b and located on the downstream side relative to the valve hole 301c of the first control valve 300 in the pressure supply passage 145 through a communication passage 104f. One end surface of the spool 352 contacts and separates from a wall surface 104e3 of the first accommodation chamber, which is the wall surface of the back pressure chamber.

In the peripheral wall of the second accommodation chamber 104e2, a communication passage 104g is formed, the communication passage 104g being configured to allow the second accommodation chamber 104e2 and the suction chamber 141 to communicate with each other.

In the end surface of the discharge valve forming plate 151 (closing member) closing an open end on the side opposite to the first accommodation chamber 104e1 of the second accommodation chamber 104e2, i.e., in the wall surface on the side opposite to the back pressure chamber in the valve chamber, the valve hole 151a is formed, and the valve seat 151b on which the other end surface of the spool 352 abuts is formed in the circumference of the valve hole 151a. The second accommodation chamber 104e2 communicates with the crank chamber 140 through the valve hole 151a, communication holes formed in the valve plate 103 and the suction valve forming plate 150, the space 101d, and the communication passage 101c. Therefore, the second pressure release passage 146b is formed by the communication passage 101c, the space 101d, the communication holes formed in the suction valve forming plate 150 and the valve plate 103, the valve hole 151a, the second accommodation chamber 104e2, and the communication passage 104g.

The closing member closing one end of the accommodation hole 101e is not limited to the discharge valve forming plate 151, but may be any member present between the cylinder block 101 and the cylinder head 104, e.g., either the suction valve forming plate 150 or the valve plate 103 may be used. Alternatively, as the closing member, a closing member for exclusive use may be added to be used. When any one of the suction valve forming plate 150, the discharge valve forming plate 151, and the valve plate 103 is used as the closing member, there is no necessity of adding a closing member for exclusive use and, since the accuracy of planarity is good, any one of the suction valve forming plate 150, the discharge valve forming plate 151, and the valve plate 103 is suitable as the closing member having a valve seat.

The pressure receiving portion 352a of the spool 352 is accommodated in the first accommodation chamber 104e1, and one end surface 352a1 thereof contacts and separates from the end wall 104e3 of the first accommodation chamber 104e1. The valve portion 352b is accommodated in the valve chamber 351c and the other end surface 352b1 thereof contacts and separates from the valve seat 151b to open and close the valve hole 151a. The shaft portion 352c connecting the pressure receiving portion 352a and the valve portion 352b is formed to have a diameter smaller than the diameters of the pressure receiving portion 352a and the valve portion 352b.

The shaft portion 352c is integrally formed with the valve portion 352b. The spool 352 is configured by press-fitting the pressure receiving portion 352a into the shaft portion 352cb in the state where the shaft portion 352c is inserted into the through-hole 351b1 of the partition member 351. When the valve portion 352b of the spool abuts on the wall surface on the side opposite to the back pressure chamber in the valve chamber 351c, the pressure receiving portion 352a of the spool abuts on the end wall 351b of the partition member. Specifically, the press-fitting position of the pressure receiving portion 352a in the axial direction thereof relative to the valve portion 352b is adjusted so that, when one end surface 352b1 of the valve portion abuts on the valve seat 151b of the discharge valve forming plate, the other end surface 352a2 of the pressure receiving portion simultaneously abuts on one end surface 351b2 of the end wall 351b.

The partition member 351 is positioned in the second accommodation chamber 104e2 so that the end surface 351a1 on the side opposite to the end wall 351b of the side wall 351a abuts on the wall surface on the side opposite to the back pressure chamber in the valve chamber 351c, specifically, a region around the valve seat 151b of the discharge valve forming plate 151, which is flush with the valve seat 151b.

Hereinafter, the spool 352 and the partition member 351 are assembled as follows, for example.

First, the integrated configuration of the valve portion 352b and the shaft portion 352c is placed on a plane V with the end surface 352b1 of the valve portion facing down, and then the shaft portion 352c is inserted into the through-hole 351b1 with the end surface 351a1 on the side opposite to the end wall 351b of the side wall 351a of the partition member 351 facing down, whereby the end surface 351*a*1 on the side opposite to the end wall is made to abut on the plane V.

Next, a through-hole 352*a*4 of the pressure receiving portion is fitted into the tip of the shaft portion 352*c* in the state described above, and then the pressure receiving portion 352*a* is press-fitted into the shaft portion 352*c* by pressing the one end surface 352*a*1 of the pressure receiving portion until the other end surface 352*a*2 of the pressure receiving portion abuts on the one end surface 351*b*2 of the end wall.

Thus, the end surface 351*a*1 on the side opposite to the end wall of the side wall is flush with the valve seat 151*b* in the variable displacement compressor 100. Therefore, when the end surface 352*b*1 of the valve portion abuts on the valve seat 151*b*, the other end surface 352*a*2 of the pressure receiving portion simultaneously abuts on the one end surface 351*b*2 of the end wall. Therefore, the position of the pressure receiving portion 352*a* in the axial direction thereof relative to the valve portion 352*b* can be easily adjusted even when the spool 352 and the partition member 351 are not attached to the cylinder head 104, and therefore the spool 352 and the partition member 351 can be appropriately assembled. Furthermore, the assembly can be achieved even when the assembly of the spool 352 and the partition member 351 is not attached to the cylinder head 104. Therefore, it can be easily examined in this assembly whether the abutment state of the end surface 352*b*1 of the valve portion and the valve seat 151*b* and the abutment state of the other end surface 352*a*2 of the pressure receiving portion and the one end surface 351*b*2 of the end wall are appropriate. For example, the assembly of the spool 352 and the partition member 351 is accommodated in an examination device, and then fluid, such as air, is supplied to measure the leakage amount of the two abutment portions, whereby it can be examined whether the abutment state is appropriate.

The partition member 351 is accommodated in the accommodation chamber 104*e* so that the end surface 351*a*1 on the side opposite to the end wall of the side wall abuts on a member present between the cylinder block 101 and the cylinder head 104. For example, the assembly of the spool 352 and the partition member 351 is temporarily press-fitted into the peripheral wall of the second accommodation chamber 104*e*2 so that the end surface 351*a*1 on the side opposite to the end wall of the side wall of the partition member protrudes only by a predetermined value (h) from the connection end surface 104*d* of the cylinder head. The compressor is assembled in this state, and then fastened with the plurality of through bolts 105, whereby the plurality of through bolts 105 is fastened in the state where the end surface 351*a*1 on the side opposite to the projected end wall of the side wall abuts on the discharge valve forming plate 151. Then, the partition member 351 is pressed into the deep side of the second accommodation chamber 104*e*2 by the pressing force due to the fastening, so that the partition member 351 is positioned in the second accommodation chamber 104*e*2 in the state where the end surface 351*a*1 on the side opposite to the end wall of the side wall abuts on the discharge valve forming plate 151. Thus, the partition member 351 can be easily positioned in the cylinder head 104 in the state where the end surface 351*a*1 on the side opposite to the end wall of the side wall abuts on the discharge valve forming plate 151. The predetermined value (h) may be set to a value in a certain fixed range.

Hereinafter, an operation of the spool 352 in the second control valve 350 will be described.

One end surface (one end surface 352*a*1 of the pressure receiving portion) of the spool 352 receives the pressure of the pressure supply passage 145 between the first control valve 300 and the check valve 250, a so-called back pressure Pm, and the other end surface (one end surface 352*b*1 of the valve portion) of the spool 352 receives the pressure Pc of the crank chamber 140, so that the spool 352 moves in the axial direction according to the pressure difference (Pm−Pc). When Pm−Pc>0 is established, the other end surface of the spool 352 abuts on the valve seat 151*b*, so that the second control valve 350 closes the second pressure release passage 146*b*. When Pm−Pc<0 is established, one end surface of the spool 352 abuts on the end wall 104*e*3, so that the second control valve 350 opens the second pressure release passage 146*b* to the maximum degree. The pressure receiving area S1 of the spool 352 in the axial direction receiving the back pressure Pm and the pressure receiving area S2 of the spool 352 receiving the pressure Pc of the crank chamber 140 are set to S1=S2, for example. However, S1>S2 or S1<S2 may be set in order to adjust an operation of the spool 352.

Between an outermost peripheral surface 352*a*3 of the pressure receiving portion slidably supported by the inner peripheral surface of the first accommodation chamber 104*e*1 and the inner peripheral surface of the first accommodation chamber 104*e*1, a minute gap is formed. Therefore, it is configured so that, in a state where the one end surface 352*a*1 of the pressure receiving portion is slightly separated from the end wall 104*e*3, the refrigerant gas flowing into the first accommodation chamber 104*e*1 from the communication passage 104*f* flows into the valve chamber 351*c* via the gap between the outermost peripheral surface 352*a*3 and the inner peripheral surface of the first accommodation chamber 104*e*1 and the gap between the outer peripheral surface of the shaft portion 352*c* and the inner peripheral surface of the through-hole 351*b*1. On the other hand, it is configured so that, when the end surface 352*b*1 of the valve portion abuts on the valve seat 151*b*, the other end surface 352*a*2 of the pressure receiving portion abuts on the one end surface 351*b*2 of the end wall. Therefore, the flow of the refrigerant from the first accommodation chamber 104*e*1 to the valve chamber 351*c* via the gap between the outer peripheral surface of the shaft portion 352*c* and the inner peripheral surface of the through-hole 351*b*1 is blocked. More specifically, the other end surface 35*a*2 of the pressure receiving portion and the one end surface 351*b*2 of the end wall form the valve unit.

The first accommodation chamber 104*e*1 and the valve chamber 351*c* communicate with each other through a communication hole 351*b*3 formed in the end wall 351*b*. Therefore, it is configured so that, when the end surface 352*b*1 of the valve portion abuts on the valve seat 151*b*, so that the second control valve 350 is closed, the refrigerant gas flowing into the first accommodation chamber 104*e*1 from the communication passage 104*f* slightly flows into the suction chamber 141 through the communication hole 351*b*3, the valve chamber 351*c*, the communication hole 351*a*2, the space of the second accommodation chamber 104*e*2 outside the side wall 351*a*, and the communication passage 104*g* provided in the cylinder head 104. The communication passage 104*f*, the first accommodation chamber 104*e*1, the communication hole 351*b*3, the valve chamber 351*c*, the communication hole 351*a*2, the space of the second accommodation chamber 104*e*2 outside the side wall 351*a*, and the communication passage 104*g* provided in the cylinder head 104 form a throttle passage for allowing a region of the pressure supply passage 145 between the first control valve 300 and the check valve 250, and the suction chamber 141 to communicate with each other. The flow passage cross-sectional area of the communication hole 351*b*3 is set to be the smallest in the throttle passage. More specifically, a throttle is formed by the communication hole 351*b*3 in the throttle passage.

It is configured so that, when the one end surface 352*a*1 of the pressure receiving portion abuts on the end wall 104*e*3 of the first accommodation chamber and the end surface 352*b*1 of the valve portion is separated from the valve seat 151*b* to the maximum degree, the region of the pressure supply passage 145 between the first control valve 300 and the check valve 250 communicates with the suction chamber 141 through the first accommodation chamber 104*e*1, the gap between the outer peripheral surface of the shaft portion 352*c* and the inner peripheral surface of the through-hole 351*b*1 (and communication hole 351*b*3), the valve chamber 351*c*, the communication hole 351*a*2, the space of the second accommodation chamber 104*e*2 outside the side wall 351*a*, and the communication passage 104*g* provided in the cylinder head 104 by a groove 352*a*5 formed in the one end surface 352*a*1 of the pressure receiving portion.

Hereinafter, an operation of the variable displacement compressor 100 will be described.

When the current application to the molded coil 314 of the first control valve 300 is blocked in the state where the variable displacement compressor 100 is operated, the first control valve 300 is opened to the maximum degree. Thus, the back pressure Pm increases, and therefore, when the check valve 250 closes the pressure supply passage 145 (at the time of the maximum discharge volume), the check valve 250 opens the pressure supply passage 145 and, simultaneously therewith, the second control valve 350 closes the second pressure release passage 146*b*. Therefore, the pressure release passage 146 contains only the first pressure release passage 146*a*, so that the pressure of the crank chamber 140 increases and the inclination angle of the swash plate 111 decreases, and thus the discharge volume is maintained at the minimum volume.

The check valve 200 closes the delivery passage almost simultaneously therewith, so that the refrigerant gas discharged with the minimum discharge volume does not flow into an external refrigerant circuit and circulates through an internal circulation passage containing the discharge chamber 142, the pressure supply passage 145, the crank chamber 140, the pressure release passage 146*a*, the suction chamber 141, and the cylinder bore 101*a*. In this state, the refrigerant gas in the region of the pressure supply passage 145 between the first control valve 300 and the check valve 250 is slightly flowing into the suction chamber 141 through the throttle passage formed in the second control valve 350.

When a current is applied to the molded coil 314 of the first control valve 300 from this state, the first control valve 300 is closed, so that the pressure supply passage 145 is closed, and thus the refrigerant gas in the region of the pressure supply passage 145 between the first control valve 300 and the check valve 250 flows into the suction chamber 141 through the throttle passage in the second control valve 350. Then, the pressure of the region of the pressure supply passage 145 between the first control valve 300 and the check valve 250 decreases, so that the check valve 250 closes the pressure supply passage 145, and thus the refrigerant gas is prevented from flowing backwards from the crank chamber 140 into the pressure supply passage 145 on the upstream relative to the check valve 250. Simultaneously therewith, the second control valve 350 opens the second pressure release passage 146*b*.

Therefore, the pressure release passage 146 contains two passages of the first pressure release passage 146*a* and the second pressure release passage 146*b* at this time.

The flow passage cross-sectional area in the second control valve 350 is set to be larger than the flow passage cross-sectional area of the fixed throttle 103*c*. The refrigerant in the crank chamber 140 promptly flows into the suction chamber 141, so that the pressure of the crank chamber 140 decreases, and thus the discharge volume promptly increases to the maximum discharge volume from the minimum discharge volume. Thus, the pressure of the discharge chamber 142 rapidly increases, so that the check valve 200 opens. Then, the refrigerant circulates through the external refrigerant circuit, and thus an air-conditioner system enters an operation state.

The air-conditioner system operates, the pressure of the suction chamber 141 decreases, and then the pressure reaches the set pressure set by a current flowing into the molded coil 314, so that the first control valve 300 is opened. Thus, the back pressure Pm increases, whereby the check valve 250 opens the pressure supply passage 145 and, simultaneously therewith, the second control valve 350 closes the second pressure release passage 146*b*. Therefore, the pressure release passage 146 contains only the first pressure release passage 146*a* at this time. Therefore, the flow of the refrigerant in the crank chamber 140 into the suction chamber 141 is restricted, so that the pressure of the crank chamber 140 easily increases. Then, the opening degree of the first control valve 300 is adjusted so that the pressure of the suction chamber 141 maintains the set pressure, and thus the discharge volume is variably controlled.

Thus, with respect to the second control valve 350, when the first control valve 300 is opened and the force of moving the spool 352 in a direction of approaching the valve hole 151*a* by the pressure applied to the pressure receiving portion 352*a* becomes larger than the force of moving the spool 352 in a direction of separating from the valve hole 151*a* by the pressure applied to the valve portion 352*b*, then the valve portion 352*b* abuts on the wall surface of the valve chamber 351*c*, to thereby close the valve hole 151*a*, so that the opening degree of the pressure release passage 146 is set to the minimum degree. Moreover, with respect to the second control valve 350, when the first control valve 300 is closed and the force of moving the spool 352 in a direction of approaching the valve hole 151*a* by the pressure applied to the pressure receiving portion 352*a* becomes smaller than the force of moving the spool 352 in a direction of separating from the valve hole 151*a* by the pressure applied to the valve portion 352*b*, then the valve portion 352*b* is separated from the wall surface, to thereby open the valve hole 151*a*, so that the opening degree of the pressure release passage 146 is set to the maximum degree. More specifically, the second control valve 350 operates interlocking with the opening and closing of the first control valve 300. When the first control valve 300 is closed, the opening degree of the pressure release passage 146 is set to the maximum degree (the first pressure release passage 146*a* and the second pressure release passage 146*b*). When the first control valve 300 is open, the opening degree of the pressure release passage 146 is set to the minimum degree (only the first pressure release passage 146*a*).

Hereinafter, a second embodiment of the second control valve will be described with reference to FIG. 8.

Figure 8:
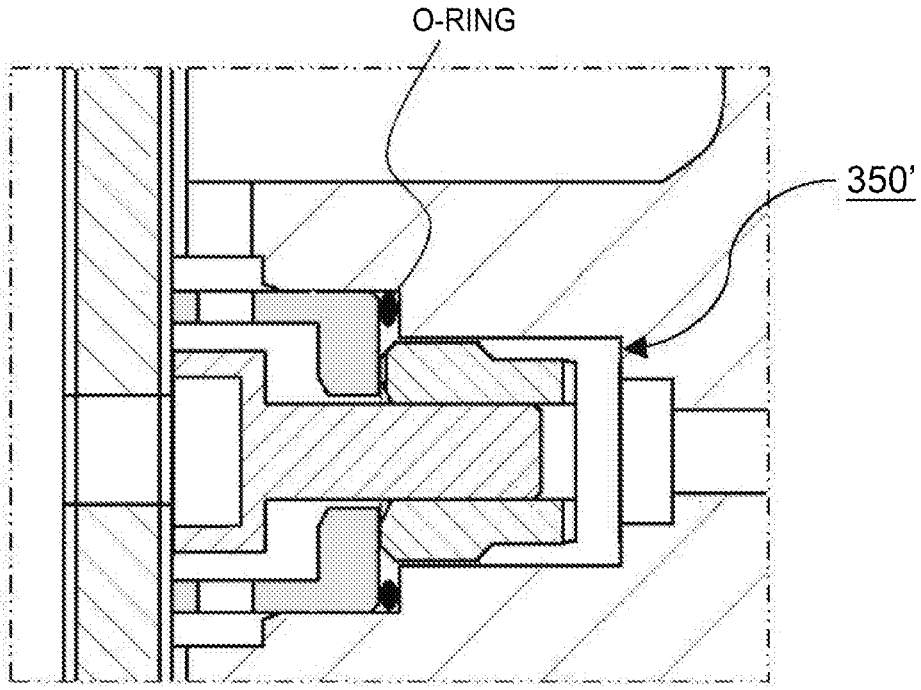
FIG. 8 is a view illustrating another example of the second control valve.

In a second control valve 350' illustrated in FIG. 8, the outer diameter of the side wall of the partition member is set to be smaller than the internal diameter of the peripheral wall of the second accommodation chamber, and the side wall is slidably supported by the peripheral wall of the second accommodation chamber.

In a level difference portion between the vicinity of the outermost portion in the radial direction of one end surface of the end wall of the partition member and the connection end surface of the second accommodation chamber and the first accommodation chamber, in other words, a level difference portion between the large diameter portion and the small diameter portion of the accommodation chamber, a seal member having elasticity, e.g., an O-ring, is arranged. The dimension of each portion is set so that an end surface 351*a*1 on the side opposite to the end wall of the side wall protrudes by only a predetermined value (h') from the connection end surface 104*d* of a cylinder head in a state where no force acts on the O-ring. The predetermined value may be a value in a certain fixed range.

When a variable displacement compressor is assembled and fastened with a plurality of through bolts 105 in this state, the plurality of through bolts 105 is fastened in a state where the protruded end surface 351*a*1 on the side opposite to the end wall of the side wall abuts on the discharge valve forming plate 151. When fastened as described above, the biasing force of the O-ring acts in a direction of pressing the partition member against the discharge valve forming plate 151. Thus, in the state where the end surface 351*a*1 on the side opposite to the end wall of the side wall abuts on the discharge valve forming plate 151, the partition member 351 is positioned in the second accommodation chamber 104*e*2.

Thus, the assembly of the spool 352 and the partition member 351 can be easily arranged in the cylinder head in the state where the end surface 351*a*1 on the side opposite to the end wall of the side wall abuts on the discharge valve forming plate 151. The O-ring can prevent the refrigerant flowing from the first accommodation chamber from flowing into the suction chamber via a gap outside the side wall. The seal member having elasticity is not limited to a member containing rubber, such as the O-ring, and may be a member containing resin.

Hereinafter, a third embodiment of the second control valve will be described with reference to FIG. 9.

Figure 9:
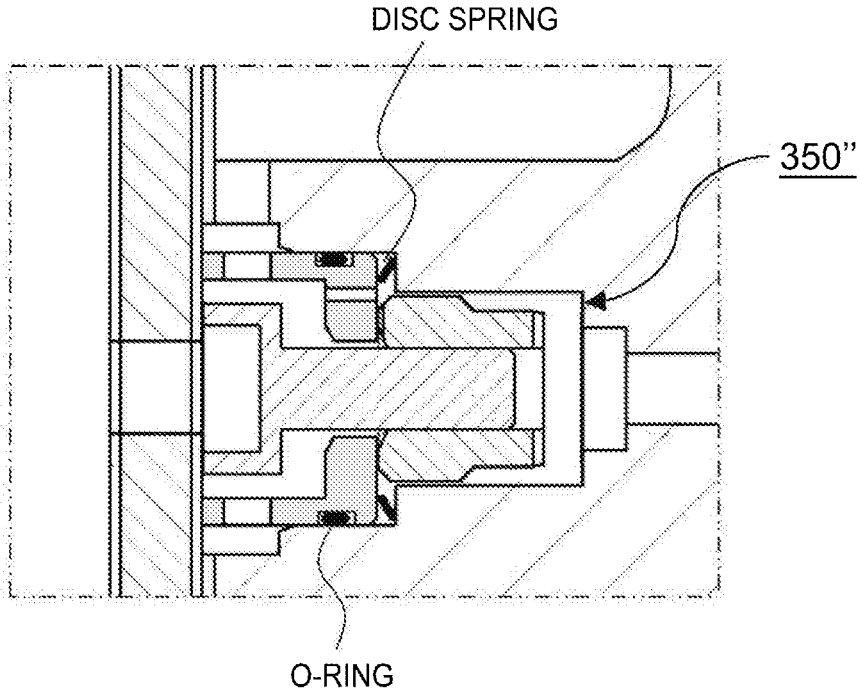
FIG. 9 is a view illustrating a still another example of the second control valve.

A second control valve 350" illustrated in FIG. 9 contains a spring (disc spring) as a biasing unit which biases the partition member. In order to prevent a refrigerant flowing from the first accommodation chamber from flowing into the suction chamber via a gap outside the side wall, an O-ring is disposed between the side wall and the first accommodation chamber. The other configurations are the same as those of the second embodiment described above.

Hereinafter, a fourth embodiment of the second control valve will be described with reference to FIG. 10.

Figure 10:
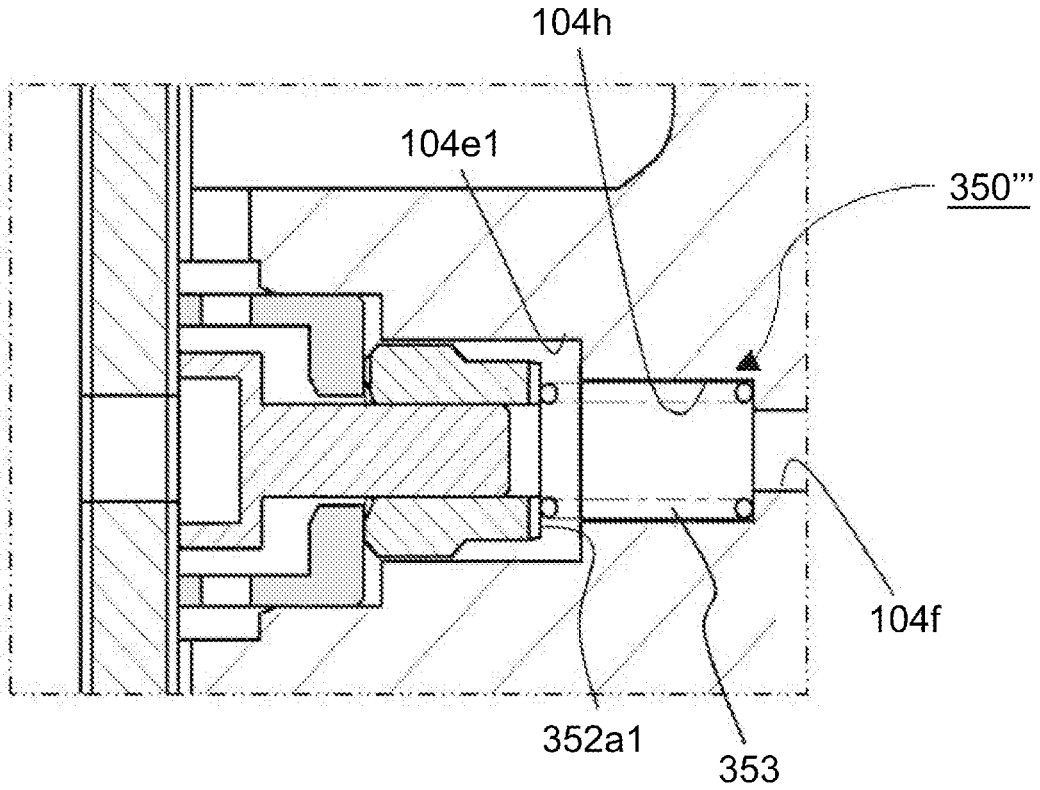
FIG. 10 is a view illustrating an example in which the second control valve has a resistance unit.

A second control valve 350'" illustrated in FIG. 10 has a biasing unit which biases the spool 352 in a direction of preventing the movement of the spool 352 when the spool 352 attempts to separate from the valve seat 151*b*.

As the biasing unit, a compression coil spring 353 biasing the spool 352 toward the valve seat 151*b* can be provided, for example. The compression coil spring 353 is accommodated in an accommodation hole 104*h* forming a part of the communication passage 104*f* and opening to the first accommodation chamber 104*e*1. One end of the compression coil spring 353 abuts on the one end surface 352*a*1 of the pressure receiving portion and the other end thereof abuts on the bottom wall of the accommodation hole 104*h*. When the end surface 352*b*1 of the valve portion abuts on the valve seat 151*b*, the compression coil spring 353 biases the spool 352 to the valve seat 151*b*.

Thus, since the compression coil spring 353 is provided, the pressure difference (Pm−Pc<0) in which the spool 352 attempts to separate from the valve seat 151*b* can be easily adjusted by the biasing force of the compression coil spring 353. The compression coil spring may be arranged in the first accommodation chamber 104*e*1.

Hereinafter, the action of such a second control valve 350'" will be described.

When a steady operation of the variable displacement compressor 100 is performed in the state where the discharge volume is maintained at the minimum volume, the pressure difference between the pressure of the discharge chamber 142 and the pressure of the suction chamber 141 decreases, so that the pressure difference between the pressure of the crank chamber 140 and the pressure of the suction chamber 141 also decreases. Particularly in a state where the outside air temperature is low and the number of rotations of the compressor is low, the pressure difference becomes very small.

Thus, the force of pressing the spool 352 against the valve seat 151*b* by the back pressure Pm becomes very small. However, in the second control valve 350'", the end surface 352*b*1 of the valve portion abuts on the valve seat 151*b* by the biasing force caused of the compression coil spring 353. Therefore, when the end surface 352*b*1 of the valve portion attempts to separate from the valve seat 151*b* in response to an external force, such as vibration, the biasing force acts on a direction of preventing the movement of the spool 352. Therefore, the end surface 352*b*1 of the valve portion is prevented from separating from the valve seat, so that unintended opening of the second pressure release passage 146*b* is avoided.

Examples described in this specification are configured so that the valve portion of the second control valve closes the second pressure release passage but a structure may be acceptable in which a groove (throttle) is provided in the end surface 352*b*1 of the valve portion, so that the second pressure release passage is not completely closed.

In Examples described in this specification, when the second control valve closes the second pressure release passage, a throttle passage is formed in the second control valve but a configuration may be acceptable in which a throttle passage is provided separately from the second control valve and the other end surface 35*a*2 of the pressure receiving portion abuts on the one end surface 351*b*2 of the end wall, so that the flow of the refrigerant from the first accommodation chamber 104*e*1 to the valve chamber 351*c* is blocked.

The second control valve may be arranged on other body constituent members, e.g., the cylinder block. The check valve 250 may be arranged in the cylinder head. The first control valve may be a mechanical control valve without a solenoid.

In Examples described in this specification, the compressor is the clutchless variable displacement compressor of a swash plate type but the compressor is not limited thereto. For example, the compressor may be a variable displacement compressor to which an electromagnetic clutch is attached or a variable displacement compressor which is driven by a motor.

REFERENCE SYMBOL LIST

100 Variable displacement compressor
140 Crank chamber
141 Suction chamber (Suction pressure region)
142 Discharge chamber (Discharge pressure region)

145 Pressure supply passage
146 Pressure release passage
151*a* Valve hole
300 First control valve
350 Second control valve
351 Partition member
351*a* Side wall
351*a*1 End surface on side opposite to end wall of side wall
351*b* End wall
351*b*1 Through-hole
351*c* Valve chamber
351*d* Back pressure chamber
352 Spool
352*a* Pressure receiving portion
352*b* Valve portion
352*c* Shaft portion

The invention claimed is:

1. A variable displacement compressor, in which a refrigerant in a discharge pressure region is supplied to a crank chamber through a pressure supply passage and the refrigerant in the crank chamber is discharged into a suction pressure region through a pressure release passage, so that a pressure in the crank chamber is regulated, whereby a discharge volume is controlled by the pressure regulation in the crank chamber, the variable displacement compressor comprising:

a first control valve that adjusts an opening degree of the pressure supply passage; and a second control valve that adjusts an opening degree of the pressure release passage, wherein the second control valve has a back pressure chamber that communicates with a region on a downstream side relative to the first control valve in the pressure supply passage, a valve chamber which is partitioned from the back pressure chamber by a partition member to form a part of the pressure release passage and is provided with a valve hole communicating with the crank chamber in a wall surface on a side opposite to the back pressure chamber, and a spool having a pressure receiving portion disposed in the back pressure chamber, a valve portion disposed in the valve chamber, and a shaft portion which extends penetrating through the partition member to connect the pressure receiving portion and the valve portion, wherein when the first control valve is opened and a force of moving the spool in a direction of approaching the valve hole by a pressure applied to the pressure receiving portion becomes larger than a force of moving the spool in a direction of separating from the valve hole by a pressure applied to the valve portion, then the valve portion of the spool abuts on the wall surface on the side opposite to the back pressure chamber of the valve chamber, to thereby close the valve hole, so that the opening degree of the pressure release passage is set to a minimum degree, and when the first control valve is closed and the force of moving the spool in the direction of approaching the valve hole by the pressure applied to the pressure receiving portion becomes smaller than the force of moving the spool in the direction of separating from the valve hole by the pressure applied to the valve portion, then the valve portion of the spool is separated from the wall surface on the side opposite to the back pressure chamber of the valve chamber, to thereby open the valve hole, so that the opening degree of the pressure release passage is set to a maximum degree, wherein the partition member has a cylindrical side wall provided so as to surround the valve portion of the spool and an end wall which is connected to one end side of the side wall and has a through-hole through which the shaft portion of the spool penetrates, and is positioned so that an end surface on a side opposite to the end wall of the side wall abuts on the wall surface on the side opposite to the back pressure chamber of the valve chamber, on which, and from which, a valve portion of the spool abuts and separates, and wherein when the valve portion of the spool abuts on the wall surface on the side opposite to the back pressure chamber of the valve chamber, the pressure receiving portion of the spool abuts on the end wall of the partition member.

2. The variable displacement compressor according to claim 1, wherein the partition member has a communication portion formed in the side wall, the communication portion being configured to allow the valve chamber and the suction pressure region to communicate with each other.

3. The variable displacement compressor according to claim 1, further comprising:

a cylinder block in which a plurality of cylinder bores are formed and partitioned;

a housing connected to one end side of the cylinder block to form the crank chamber;

a cylinder head which is connected to another end side of the cylinder block and in which a suction chamber as the suction pressure region and a discharge chamber as the discharge pressure region are formed;

a drive shaft rotatably supported in a body containing the housing, the cylinder block, and the cylinder head;

a piston arranged in each of the plurality of cylinder bores; and a swash plate which is configured to have a variable inclination angle and to convert rotation of the drive shaft to a reciprocation motion of the piston, wherein a discharge volume is controlled by a variation of a stroke of the piston varied due to a variation of the inclination angle of the swash plate by the pressure regulation in the crank chamber, and wherein the wall surface of the valve chamber in the second control valve is an end surface of a member present between the cylinder block and the cylinder head.

4. The variable displacement compressor according to claim 3, wherein the member is any one of a valve plate in which discharge ports and suction ports communicating with the plurality of cylinder bores are formed, a discharge valve forming plate in which the discharge valves opening and closing the discharge ports are formed, and a suction valve forming plate in which the suction valves opening and closing the suction ports is formed.

5. The variable displacement compressor according to claim 3, wherein the partition member is accommodated in an accommodation chamber formed in a cylinder block side end surface of the cylinder head, so that an end surface opposite to the end wall of the side wall abuts on the member.

6. The variable displacement compressor according to claim 5, wherein the partition member is movably fitted into the accommodation chamber, and the second control valve has a biasing unit which biases the partition member toward the end surface of the member.

7. The variable displacement compressor according to claim 6, wherein the accommodation chamber is formed into a cylindrical shape and has a large diameter portion on a side of the cylinder block in the cylinder head, a small diameter portion on a deep side relative to the large diameter portion, and a level difference portion between the large diameter portion and the small diameter portion, the partition member has an outer diameter larger than a diameter of the small diameter portion and is accommodated in the large diameter portion, and the biasing unit is a seal member having elasticity and arranged between the partition member and the level difference portion.

* * * * *